United States Patent [19]

Lilley

[11] 4,440,636

[45] Apr. 3, 1984

[54] RECOVERY IN PHOSPHATE ORE FLOTATION PROCESS

[75] Inventor: George M. Lilley, Lakeland, Fla.

[73] Assignee: J. Warren Allen, Lithia, Fla. ; a part interest

[21] Appl. No.: 347,694

[22] Filed: Feb. 11, 1982

[51] Int. Cl.[3] ..... B03D 1/14

[52] U.S. Cl. ..... 209/10; 209/166; 209/167

[58] Field of Search ..... 209/10, 166, 167, 17

[56] References Cited

U.S. PATENT DOCUMENTS

| | | | |
|---|---|---|---|
| 2,753,997 | 7/1956 | Duke et al. | 209/166 |
| 2,815,859 | 12/1957 | Hollingsworth | 209/167 |
| 3,013,664 | 12/1961 | Hollingsworth et al. | 209/167 |
| 3,259,326 | 7/1966 | Duke et al. | 209/3 |
| 3,314,537 | 4/1967 | Greene et al. | 209/167 |

FOREIGN PATENT DOCUMENTS

| | | | |
|---|---|---|---|
| 528295 | 7/1956 | Canada | 209/166 |

*Primary Examiner*—Bernard Nozick

*Attorney, Agent, or Firm*—Frijouf, Rust & Pyle

[57] ABSTRACT

A method is disclosed for improving the recovery of a conventional single or double stage flotation process for the benefication of phosphate ore. The method includes treating the discarded froth product of the conventional phosphate proces with waste slime from the flotation process. The slime and froth product is agitated to completely deactive the cationic reagent prior to the anionic treatment with new phosphate ore in a conventional flotation process.

2 Claims, 2 Drawing Figures

RECOVERY IN PHOSPHATE ORE FLOTATION PROCESS

BACKGROUND OF THE INVENTION

1. Field of the Invention

This invention relates to a method of improved phosphate rcovery in a flotation of phosphate ore and more particularly to the recovery of phosphate from the froth product tailings which are now considered waste product of a conventional flotation process.

2. Description of the Prior Art

Various types of methods have been devised by the prior art for processing raw phosphate ore into phosphate by-products including phosphoric acid, superphosphoric acid, fertilizers and the like. The various processes have been adapted in accordance with the type of phosphate ore present in various parts of the world and in accordance with the amount of phosphate contained in the ore matrix. Different grade matrix ores required different processes for extracting the phosphate from the ore in the most economical way.

The double flotation process is commercially used for the beneficiation of phosphate ore when the phosphate ore matrix contains impurities such as silicate materials. In this process, the beneficiation of phosphate ore begins by digging the ore matrix from the ground. The ore matrix is used to form a slurry with water and pumped to a beneficiation plant. The coarse phosphate rock is screened out on a screen size generally −20 mesh. Material passing through the −20 mesh screen is deslimed at 150 mesh. The material passing through the 150 mesh is called "slimes" and contains mostly clay, silica and phosphate. The slime is typically discarded in the conventional double flotation process. The usable ore typically (−20 to +150 mesh) is passed through a first flotation process for extracting the phosphate from the deslimed matrix. The usable ore is treated with a fatty acid fuel-oil (an anionic agent) conditioned in an alkali solution which causes the desired phosphate ore to float upon an underfloat. The underflow, generally called "rougher tailings" is discarded in the conventional flotation process. The desired phosphate ore or overfloat, typically called "rougher concentrate" is deoiled with sulphuric acid to remove the anionic reagent and is then washed with water. Thereafter, the washed overfloat is treated with an amine and kerosene (cationic reagent) in a second flotation process. The second flotation process removes silica which floated during the first flotation process generally called "froth product tailings" to produce a final concentrate grade of 70–76 percent BPL (boned phosphate of lime) which is the desired product from the flotation process. The forth product tailings which are separated in the second stage from the final concentrate grade of phosphate is discarded under most prior art flotation processes. This froth product tailing contains from 8%–25% BPL, but have been considered waste and discarded since there has not been an efficient and inexpensive method of extracting the 8%–25% BPL from the froth product tailing.

Arthur Crago disclosed in U.S. Pat. No. 2,293,640, a method of concentrating phosphate materials from ore which comprises, in the first step, subjecting the ore to an aqueous pulp to a concentrating operation with negative ion reagents to separate a rougher concentrate of the phosphate ore and entrained silicious gangue. The second step of the Crago process involved treating the rougher phosphate concentrate with a mineral acid to neutralize the negative ion reagent used in the production of the rougher concentrate. The third step of the Crago process included subjecting the acid treated rougher phosphate concentrate with a positive ion reagent. The positive ion reagent is a selective collector for the gangue which is material largely composed of silicious gangue thereby producting the final phosphate concentrate.

A further improvement of the Crago process was disclosed by James D. Duke et al in U.S. Pat. No. 2,753,996. Duke et al improved upon the Crago method since Duke recognized a substantial loss of phosphate ore in the silicious froth product since in practice it is impossible to produce pure silica float. In the concentration of phosphate material by flotation employing only negative ion reagents, the middling product from the cleansing operation is often returned and passed through the process again with a new phosphate ore. However, the silicious froth product cannot be treated as a middling in that way. In attempting to follow such a procedure in practicing the Crago method, a considerable amount of silica floats with the rougher concentrate thus lowering the grade of the finished phosphate concentrate. In addition, some of the phosphate does not float thus causing a loss of phosphate in the tailings and the accumulation of phosphate in the middling which is returned to the original feed. In the practice of the Crago method, the silicious froth product containing a large amount of the silica which was removed from the rougher flotation product was discarded along with a considerable amount of phosphate.

Accordingly, Duke proposed the treatment of the silicious froth product with positive ion reagents as a middling in a manner which permits the recovery of a larger part of the phosphate which was heretofore discarded.

In the Duke process, the silicious frother product is agitated in an aqueous pulp with a colloidal clay such as bentonite, phosphatic clay, kaolin or Fuller's earth. Duke further proposed that the step of agitating the silicious middling with a colloidal clay took place before returning the middlings to the new feed and that the middlings be added to the new feed after the new feed had been conditioned with the necessary negative ion reagent.

The Duke process proposed a novel concept for the improved recovery of the concentration of phosphate materials, but unfortunately systems utilizing this method experienced substantial build-up of the silicious materials within the flotation process which substantially lowers the final grade of phosphate concentrate or lowers the efficiency of the separation in the first and second flotation processes.

Therefore, it is an object of this invention to provide a method for improving the recovery in a conventional phosphate ore flotation process which recovers at least a portion of the phosphate in the froth product tailing without the build-up of silicious material within the primary flotation process.

Another object of this invention is to provide a method for improving the recovery in a conventional phosphate ore flotation process which utilizes a discarded by-product as an activating agent for the recycling of the froth product tailings.

Another object of this invention is to provide a method for improving the recovery in a conventional phosphate ore flotation process which will produce both high grade phosphate ore and an improved recovery without the undesired build-up of silicious material within the flotation process.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention may be incorporated into a method for improving the recovery in a phosphate flotation process including the steps of treating the froth product with slime to at least partially deactivate the cationic agent and agitating the partially deactivated froth product to completely deactivate the froth product prior to an anionic treatment of the new feed in the conventional flotation process. In more specific embodiments of the invention, the method may include agitating the partially deactivated froth product independently or with the new feed in the flotation process prior to the anionic treatment of the new feed enabling the silicous materials of the froth product to be removed in the first flotation process to allow recovery of the phosphate ore present in the froth product by the second flotation process.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DISCUSSION

Figure 1:
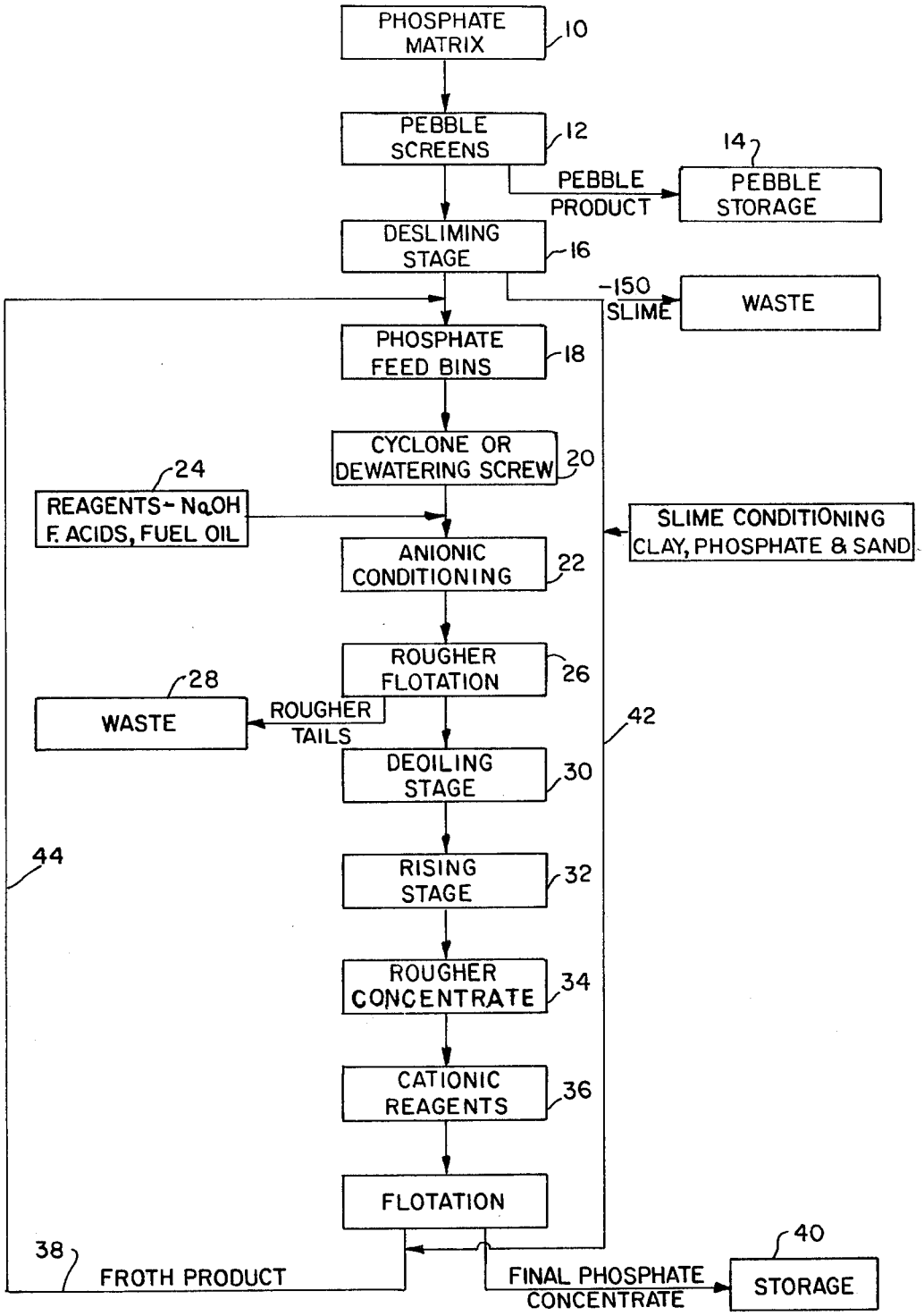
FIG. 1 is a flow diagram of a first embodiment of the present invention.

FIG. 1 illustrates a flow diagram for a conventional double flotation phosphate process with the addition of the present invention. The phosphate matrix of phosphate ore 10 is passed through pebble screens 12 with the pebble product being directed to a pebble storage 14. The phosphate matrix passing through the pebble screen 12 is directed to a desliming stage 16 wherein materials having a particle size under 150 mesh commonly known as slime is removed from the remainder of the phosphate matrix. The larger particle size phosphate ore is passed through a phosphate feed bin 18 to a cyclone or dewatering screw 20. The phosphate is then treated in an anionic stage 22 by a reagent 24 such as sodium hydroxide, fatty acids, and fuel oil. The mixture is passed through a rougher flotation process 26 wherein the rougher tailings which contain mostly silica and phosphate are overfloated and discarded as waste 28. The underfloat is passed to a deoiling stage 30 and a rinsing stage 32 to provide a rougher concentrate 34. The rougher concentrate 34 is treated with a cationic reagent at conditioning stage 36 to provide a second floatation whereby the froth product 38 is separated from the final phosphate concentrate 40.

The present invention utilizes the under 150 mesh slime along line 42 which contains mostly clay, phosphate and sand for mixing with the froth product 38 to at least partially neutralize the cationic reagent introduced under the cationic conditioning stage 36. The mixture of the slime and froth product is introduced by line 44 into the primary process prior to the anionic conditioning 22. In this example, the froth product 38 and slime is introduced by line 44 betwen the desliming stage 16 and the phosphate feed bin 18 but it should be understood that the mixture may be introduced anywhere prior to the anionic conditioning stage 22. The mixture of froth product and slime is passed through the phosphate feed bin 18 to mix with the new feed prior to the cyclone or dewatering screw 20 which enables the cationic reagents to be completely neutralized prior to the anionic conditioning stage 22.

Figure 2:
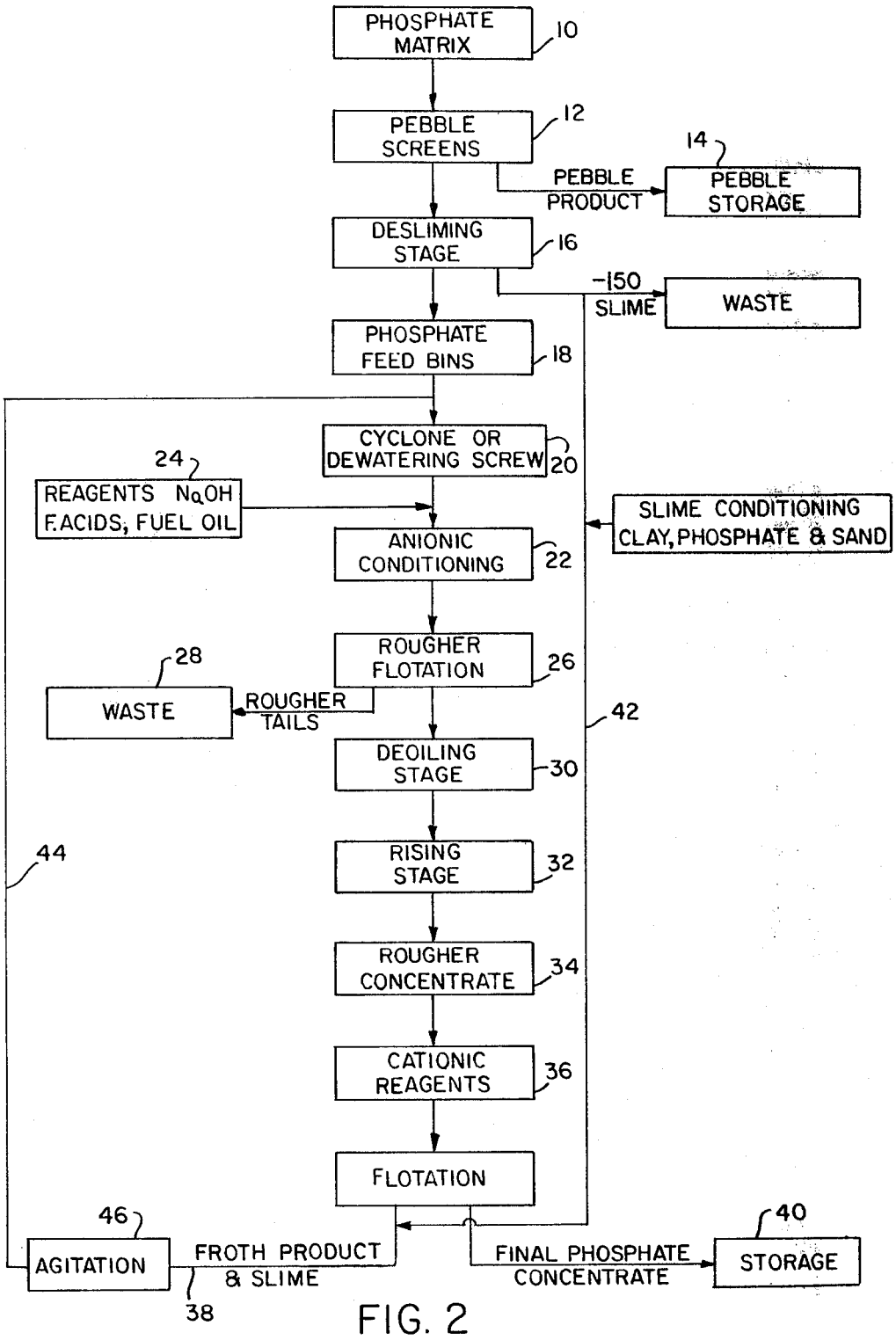
FIG. 2 is a flow diagram of a second embodiment of the present invention.

FIG. 2 illustrates a variation of the invention shown in FIG. 1 with the inclusion of an independent agitating stage 46 which completely neutralizes the cationic reagent from the reagent stage 36 of the froth product and slime prior to introduction into the conventional phosphate process. Either or both of these methods may be desired depending upon the particular type of ore and the efficiency of the process involved.

The methods, including the Duke method, which have been proposed to reclaim the phosphate in the froth product have not succeeded because these processes have failed to completely neutralize the cationic reagent coating on the particles of the froth product tailings 38. Accordingly, these processes have failed to give a high grade or additional recovery needed to be successful due to the recycled build-up of silicates. The recycling of the froth product without the complete deactivation of the cationic reagent causes a reduction of the final concentrate with silica present in the froth product tailings.

In other methods of attempting to enhance the flotation process, the method of partially deactivating the froth product and returning this partially deactivated froth product to the rougher tailings after conditioning with reagents was similarly not successful because much of the phosphate was lost in the rougher tailings and discarded. The present invention improves upon the prior art since the froth product tailings are treated with slime to partially deactivate the ore. The partially deactivated ore is then agitated with the new ore prior to the anionic condition to completely deactivate the froth product tailings. Accordingly, when the mixture is conditioned and floated in the anionic stage 22, the silicas from the froth product will discharge with the rougher tails and the phosphate from the froth product will pass with the rougher concentrate and carry along to the final phosphate concentrate.

Examples of standard processes and a process using the aforementioned invention include:

EXAMPLE I

A −20 to +150 mesh phosphate ore sample of 1000 grams was scrubbed for 30 seconds, rinsed and conditioned with anionic reagents and floated. The rougher tails, 3.35% BPL, were discarded. The rougher concentrate was then deoiled, rinsed and treated with cationic reagents for second stage float. The froth product tailings, 18.65% BPL, was discarded. The final concentrate produced a 74.64% BPL and a BPL recovery of 81.9%. The above test was repeated four times and composited. Following are the results:

| Product | % Wt. | | % BPL | | % Insol. | BPL Units | | % BPL Rec. | |
|---|---|---|---|---|---|---|---|---|---|
| Rough Tails | 72.1 | 78.3 | 3.35 | 4.56 | — | 2.41 | 3.57 | 12.2 | 17.9 |
| Froth Prod. Tails | 6.2 | | 18.65 | | — | 1.16 | | 5.9 | |
| Final Concentrate | 21.7 | | 74.64 | | 2.24 | 16.20 | | 81.9 | |
| Composite Head | 100.0 | | | | | 19.77 | | 100.0 | |

EXAMPLE II

A 1000 gram sample of −20 to +150 mesh phosphate ore was treated in the same manner as in Example I except the froth product tailings were agitated in slimes for 15 seconds. The froth product was then deslimed and put in a container. New feed was added to make another 1000 gram sample. The sample was then scrubbed 30 seconds, rinsed and conditioned with reagents and floated as in Example I. The procedure was repeated four times and composited. Following are the results:

| Product | % Wt. | % BPL | % Insol. | BPL Units | % BPL Rec. |
|---|---|---|---|---|---|
| Rough Tails | 76.6 | 3.12 | — | 2.39 | 12.1 |
| Final Concentrate | 23.4 | 74.31 | 2.30 | 17.39 | 87.9 |
| Composite Head | 100.0 | | | 19.78 | 100.0 |

Although various reagents may be used with the process, the conventional reagents used in the conventional flotation processes have been found to operate satisfactorily with the present invention. The anionic reagent may include a caustic soda and ammonia for use as an alkali solution. The fatty acid reagent is generally a blend from tall oil, vegetable oil, animal products or a combination thereof. These products typically include additives such as 5%–20% rosin, 100%–150% acid number and 15%–35% unsaponifiables. The fuel oils typically comprise low grade petroleum products which are used to make fatty acid products more fluid. Sulphuric acid is typically used in the deoiling stage to wash the reagent from the product.

The cationic reagents include condensate amines, tallow amines or ether amines. The condensating amines are produced from the reaction of fatty acids with poly, delta, teta or tepa amines. Tallow amines are typically produced from reactions of tallow fatty acids with ammonia and hydrogenated to obtain the desired amines. The ether amines are typically produced by reactions from alcohols and ammonia and hydrogenated to obtain the desired amines. Each of these cationic reagents may be free base or neutralized.

The aforementioned are some of the basic reagents used in the benefication of phosphate and sand products. Many reagent companies blend many different formulations of each or a combination of all of the above for different and specific applications. However, the foregoing process has been found to be suitable for use with the conventional reagents used in the flotation plants for the ore from phosphate deposits in the State of Florida.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. The method of improving the recovery in a phosphate flotation process comprising the steps of:
   - treating the phosphate ore with an anionic reagent to float the phosphate ore as a phosphate overfloat;
   - removing the anionic reagent from the phosphate overfloat;
   - treating the phosphate overfloat with a cationic reagent to underfloat the phosphate and to overfloat a froth product containing limited amounts of phosphate;
   - treating the froth products with a slime under 150 mesh containing clay, silica and phosphate to at least partially deactivate the cationic reagent;
   - agitating the partially deactivated froth product with the slime to further deactivate the cationic reagent in the froth product; and
   - introducing the froth product into the phosphate flotation process prior to the adding of the anionic reagent.

2. The method of improving the recovery in a double stage phosphate flotation process comprising the steps of:
   - screening the raw phosphate ore;
   - desliming the screened phosphate ore to separate the waste slime from the phosphate ore;
   - treating the deslimed phosphate ore with an anionic reagent to float the phosphate ore as a phosphate overfloat;
   - removing the anionic reagent from the phosphate overfloat;
   - treating the phosphate overfloat with a cationic reagent to underfloat the phosphate and to overfloat a froth product containing limited amounts of phosphate;

treating the froth products with a portion of the waste slime under 150 mesh containing clay, silica and phosphate to at least partially deactivate the cationic reagent;

reintroducing the froth product and the portion of the waste slime into the phosphate flotation process immediately after the desliming process to partially deactivate the cationic reagent in the froth product;

treating the deactivated froth product and deslimed phosphate ore with an anionic reagent to float the phosphate ore from the froth product and from the deslimed phosphate ore as a phosphate overfloat;

removing the anionic reagent from the phosphate overfloat; and treating the phosphate overfloat with a cationic reagent to underfloat the phosphate.

* * * * *

UNITED STATES PATENT AND TRADEMARK OFFICE

CERTIFICATE OF CORRECTION

PATENT NO. : 4,440,636

DATED : April 3, 1984

INVENTOR(S) : George M. Lilley

It is certified that error appears in the above-identified patent and that said Letters Patent are hereby corrected as shown below:

In the Abstract

Line 5, delete [proces] and insert --process--.

In the Specification

Column 1, line 8, delete [rcvery] and insert --recovery--.

Column 2, line 38, delete [frother] and insert --froth--.

Signed and Sealed this

*Sixth* Day of *August 1985*

[SEAL]

*Attest:*

DONALD J. QUIGG

*Attesting Officer* *Acting Commissioner of Patents and Trademarks*